US005990808A

United States Patent [19]

Baer

[11] Patent Number: 5,990,808

[45] Date of Patent: Nov. 23, 1999

[54] LOCAL INCIDENT REDUCING DEVICE

[76] Inventor: Eric S. Baer, 1127 W 200 N, Wabash, Ind. 46992

[21] Appl. No.: 08/985,165

[22] Filed: Dec. 4, 1997

[51] Int. Cl.[6] ..... G08G 1/07

[52] U.S. Cl. ..... 340/907; 340/902; 340/916; 701/117; 701/301; 455/420

[58] Field of Search ..... 340/902, 904, 340/905, 907, 916, 917; 701/117, 301; 455/419, 420, 422, 403

[56] References Cited

U.S. PATENT DOCUMENTS

| | | | |
|---|---|---|---|
| 4,443,783 | 4/1984 | Mitchell | 340/825.72 |
| 5,014,052 | 5/1991 | Obeck | 340/906 |
| 5,182,555 | 1/1993 | Sumner | 340/905 |
| 5,345,232 | 9/1994 | Robertson | 340/906 |
| 5,504,482 | 4/1996 | Schreder | 340/995 |
| 5,602,739 | 2/1997 | Haagenstad et al. | 340/906 |
| 5,745,865 | 4/1998 | Rostoker et al. | 701/117 |

*Primary Examiner*—Daniel J. Wu

[57] ABSTRACT

A traffic light remote control system comprising a plurality of traffic lights each situated at a single road intersection and having a green light, a yellow light, and a red light constituting an array of racing lights. Associated therewith is a programmable logic controller connected to each of the traffic lights of the single road intersection and adapted to flash each of the array of racing lights thereof only upon the receipt of an activation signal with an accompanying unique code associated therewith. Also included is a cellular transceiver connected to the programmable logic controller with a modem connected therebetween. The modem and cellular transceiver serve to communicate signals over a unique cellular line with a unique phone number dedicated to the plurality of traffic lights of the single intersection. Next provided is a mobile actuator unit including an activation button for transmitting the activation signal upon the depression thereof and a phone number and code entering mechanism for providing a phone number and associated code. A cellular transceiver is provided for communicating signals over a unique cellular line associated with a unique phone number upon the receipt thereof. Finally, a microcontroller is adapted to transmit the activation signal, a phone number and associated code to the transceiver upon the depression of the activation button.

1 Claim, 3 Drawing Sheets

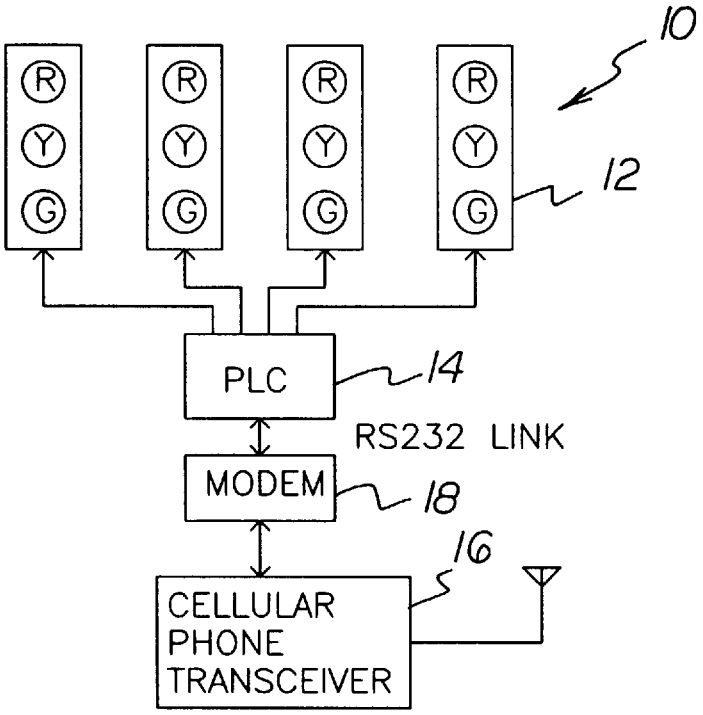
FIG. 1
FIG. 2
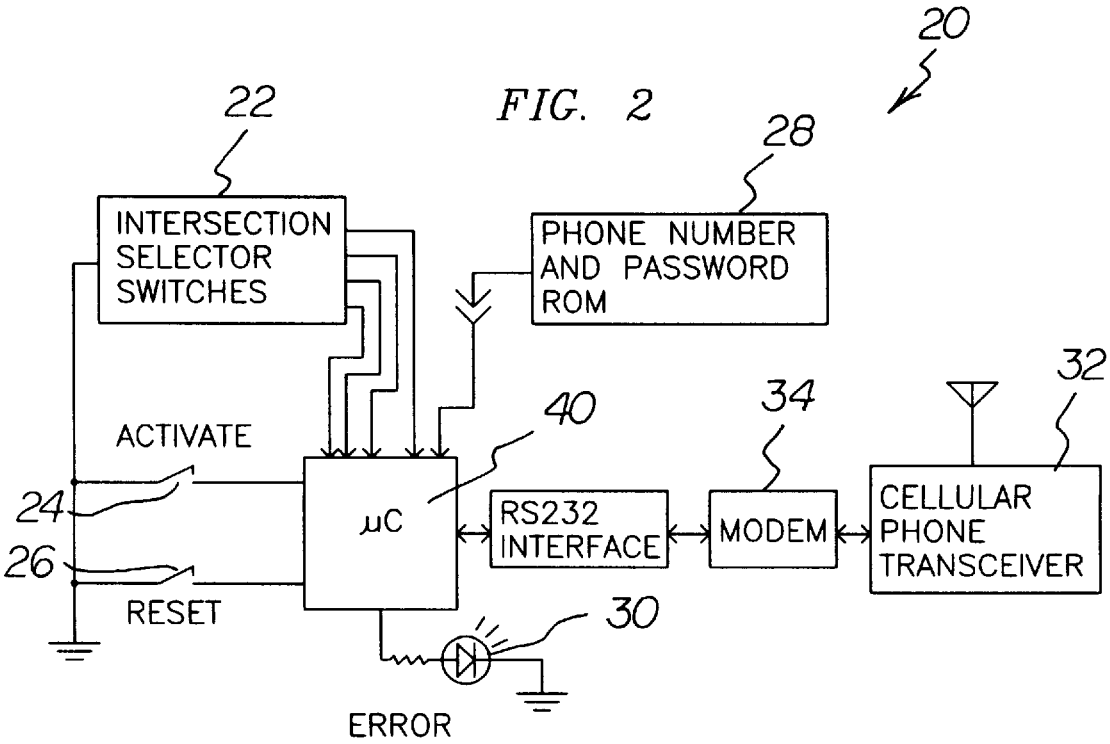

LOCAL INCIDENT REDUCING DEVICE

BACKGROUND OF THE INVENTION

1. Field of the Invention

The present invention relates to traffic light controllers and more particularly pertains to a new local incident reducing device for controlling the operation of traffic signals of a specific intersection.

2. Description of the Prior Art

The use of traffic light controllers is known in the prior art. More specifically, traffic light controllers heretofore devised and utilized are known to consist basically of familiar, expected and obvious structural configurations, notwithstanding the myriad of designs encompassed by the crowded prior art which have been developed for the fulfillment of countless objectives and requirements.

Known prior art traffic light controllers include U.S. Pat. No. 5,345,232; U.S. Pat. No. 5,187,476; U.S. Pat. Des. 361,731; U.S. Pat. No. 5,287,411; U.S. Pat. No. 5,014,052; and U.S. Pat. No. 4,443,783.

In these respects, the local incident reducing device according to the present invention substantially departs from the conventional concepts and designs of the prior art, and in so doing provides an apparatus primarily developed for the purpose of controlling the operation of traffic signals of a specific intersection.

SUMMARY OF THE INVENTION

In view of the foregoing disadvantages inherent in the known types of traffic light controllers now present in the prior art, the present invention provides a new local incident reducing device construction wherein the same can be utilized for controlling the operation of traffic signals of a specific intersection.

The general purpose of the present invention, which will be described subsequently in greater detail, is to provide a new local incident reducing device apparatus and method which has many of the advantages of the traffic light controllers mentioned heretofore and many novel features that result in a new local incident reducing device which is not anticipated, rendered obvious, suggested, or even implied by any of the prior art traffic light controllers, either alone or in any combination thereof.

To attain this, the present invention generally comprises a plurality of traffic lights, as shown in FIG. 1. It should be noted that each traffic light is situated at a single road intersection. Further, each traffic light has a green light, a yellow light, and a red light constituting an array of racing lights, as is conventional in the art of traffic signals. Connected to each of the traffic lights of the single road intersection is a programmable logic controller. Such controller is adapted to flash each of the array of racing lights of the traffic lights only upon the receipt of an activation signal with an accompanying unique code. Such code is unique to the programmable logic controller. The programmable logic controller further serves to cease such flashing of the array of racing lights upon the receipt of a reset signal or the cessation of a predetermined amount of time, whichever occurs first. For reasons that will become apparent hereinafter, the programmable logic controller also transmits an error signal upon the receipt of the activation signal with an accompanying unique code that is improper. A cellular transceiver is connected to the programmable logic controller with a modem connected therebetween. Together, the modem and cellular transceiver function to communicate signals over a unique cellular line with a unique phone number. This phone number is dedicated to the plurality of traffic lights of the single intersection. Next provided is a mobile actuator unit situated in each of a plurality of emergency vehicles. Each actuator unit includes a plurality of selector switches adapted transmit a sequence of binary signals representative of one of a plurality of intersections. Note FIG. 2. An activation button is included for transmitting the activation signal upon the depression thereof. Associated therewith is a reset button for transmitting the reset signal upon the depression thereof. Also included as a component of each mobile actuator unit is a ROM look-up table. Stored in such memory is a plurality of phone numbers and associated codes each corresponding to one of the aforementioned unique binary sequences. For reasons that will be disclosed later, a light emitting diode is provided. The light emitting diode is adapted to illuminate upon the actuation thereof. For communication purposes, a cellular transceiver and modem is provided with each mobile actuator unit. Such transceiver and modem are included for communicating signals over a unique cellular line associated with a unique phone number. Such cellular line is dialed, or connected, upon the receipt of the phone number. Finally, a microcontroller is connected to the selector switches, activation button, reset button, ROM look up table, light emitting diode, and the cellular transceiver. In use, the microcontroller is adapted to transmit the activation signal, a phone number and associated code to the transceiver upon the depression of the activation button. It should be noted that such phone number and associated code correspond to a current binary sequence of the selection switches. As such, the transceiver receives the phone number and transmits the activation signal and code to a cellular transceiver and programmable logic controller associated with the cellular line and code. The microcontroller is further adapted to transmit the reset signal after the transmission of the activation signal only upon the depression of the reset button. As set forth hereinabove, this allows the traffic lights to resume normal operation. Once the reset button is transmitted, the transceiver is adapted to automatically disconnect the line. To indicate that the programmable logic controller was unable to flash the array of racing lights of a desired set of traffic lights, the microcontroller is adapted to actuate the light emitting diode upon the receipt of the error signal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new local incident reducing device apparatus and method which has many of the advantages of the traffic light controllers mentioned heretofore and many novel features that result in a new local incident reducing device which is not anticipated, rendered obvious, suggested, or even implied by any of the prior art traffic light controllers, either alone or in any combination thereof.

It is another object of the present invention to provide a new local incident reducing device which may be easily and efficiently manufactured and marketed.

It is a further object of the present invention to provide a new local incident reducing device which is of a durable and reliable construction.

An even further object of the present invention is to provide a new local incident reducing device which is susceptible of a low cost of manufacture with regard to both materials and labor, and which accordingly is then susceptible of low prices of sale to the consuming public, thereby making such local incident reducing device economically available to the buying public.

Still yet another object of the present invention is to provide a new local incident reducing device which provides in the apparatuses and methods of the prior art some of the advantages thereof, while simultaneously overcoming some of the disadvantages normally associated therewith.

Still another object of the present invention is to provide a new local incident reducing device for controlling the operation of traffic signals of a specific intersection.

Even still another object of the present invention is to provide a new local incident reducing device that includes a plurality of traffic lights each situated at a single road intersection and having a green light, a yellow light, and a red light constituting an array of racing lights. Associated therewith is a programmable logic controller connected to each of the traffic lights of the single road intersection and adapted to flash each of the array of racing lights thereof only upon the receipt of an activation signal with an accompanying unique code associated therewith. Also included is a cellular transceiver connected to the programmable logic controller with a modem connected therebetween. The modem and cellular transceiver serve to communicate signals over a unique cellular line with a unique phone number dedicated to the plurality of traffic lights of the single intersection. Next provided is a mobile actuator unit including an activation button for transmitting the activation signal upon the depression thereof and a phone number and code entering mechanism for providing a phone number and associated code. A cellular transceiver is provided for communicating signals over a unique cellular line associated with a unique phone number upon the receipt thereof. Finally, a microcontroller is adapted to transmit the activation signal, a phone number and associated code to the transceiver upon the depression of the activation button.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic diagram of the traffic lights, programmable logic controller, and associated transceiver of the present invention.

FIG. 2 is a schematic diagram of one of the mobile actuator units of the present invention.

DESCRIPTION OF THE PREFERRED EMBODIMENT

Figure 3:
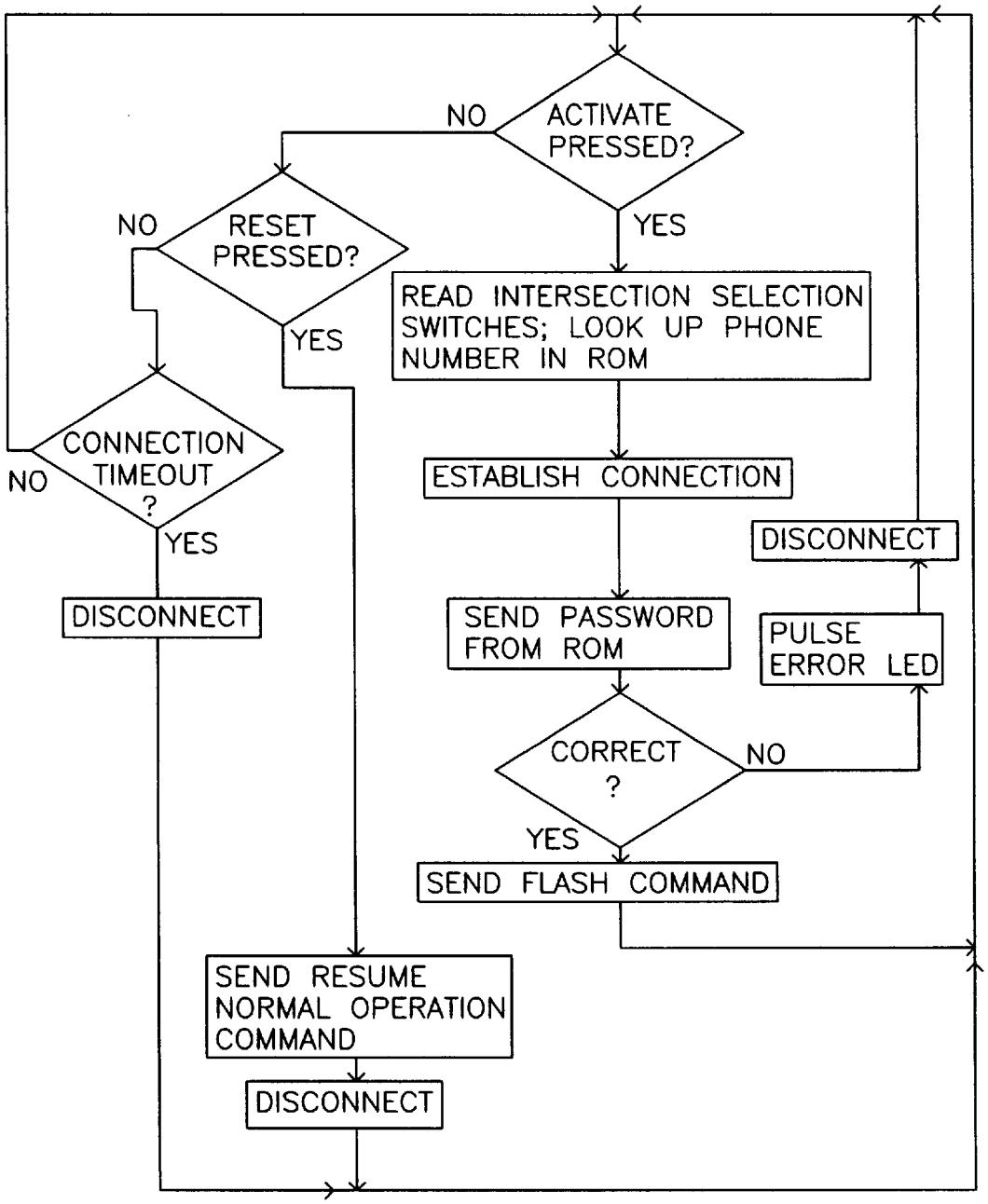
FIG. 3 is a flow chart depicting the operation of the mobile actuator of the present invention.

With reference now to the drawings, and in particular to FIGS. 1 through 4 thereof, a new local incident reducing device embodying the principles and concepts of the present invention and generally designated by the reference numeral 10 will be described.

The system 10 of the present invention first includes a plurality of traffic lights 12, as shown in FIG. 1. It should be noted that each traffic light is situated at a single road intersection. Further, each traffic light has a green light, a yellow light, and a red light constituting an array of racing lights, as is conventional in the art of traffic signals.

Connected to each of the traffic lights of the single road intersection is a programmable logic controller 14. Such controller is adapted to flash each of the array of racing lights of the traffic lights only upon the receipt of an activation signal with an accompanying unique code. Such code is unique to the programmable logic controller. The programmable logic controller further serves to cease such flashing of the array of racing lights upon the receipt of a reset signal or the cessation of a predetermined amount of time, whichever occurs first. For reasons that will become apparent hereinafter, the programmable logic controller also transmits an error signal upon the receipt of the activation signal with an accompanying unique code that is improper.

A cellular transceiver 16 is connected to the programmable logic controller with a modem 18 connected therebetween. Together, the modem and cellular transceiver function to communicate signals over a unique cellular line with a unique phone number. This phone number is dedicated to the plurality of traffic lights of the single intersection. It should be noted that the traffic lights of each intersection are equipped with the programmable logic controller, modem, and transceiver as set forth hereinabove.

Figure 4:
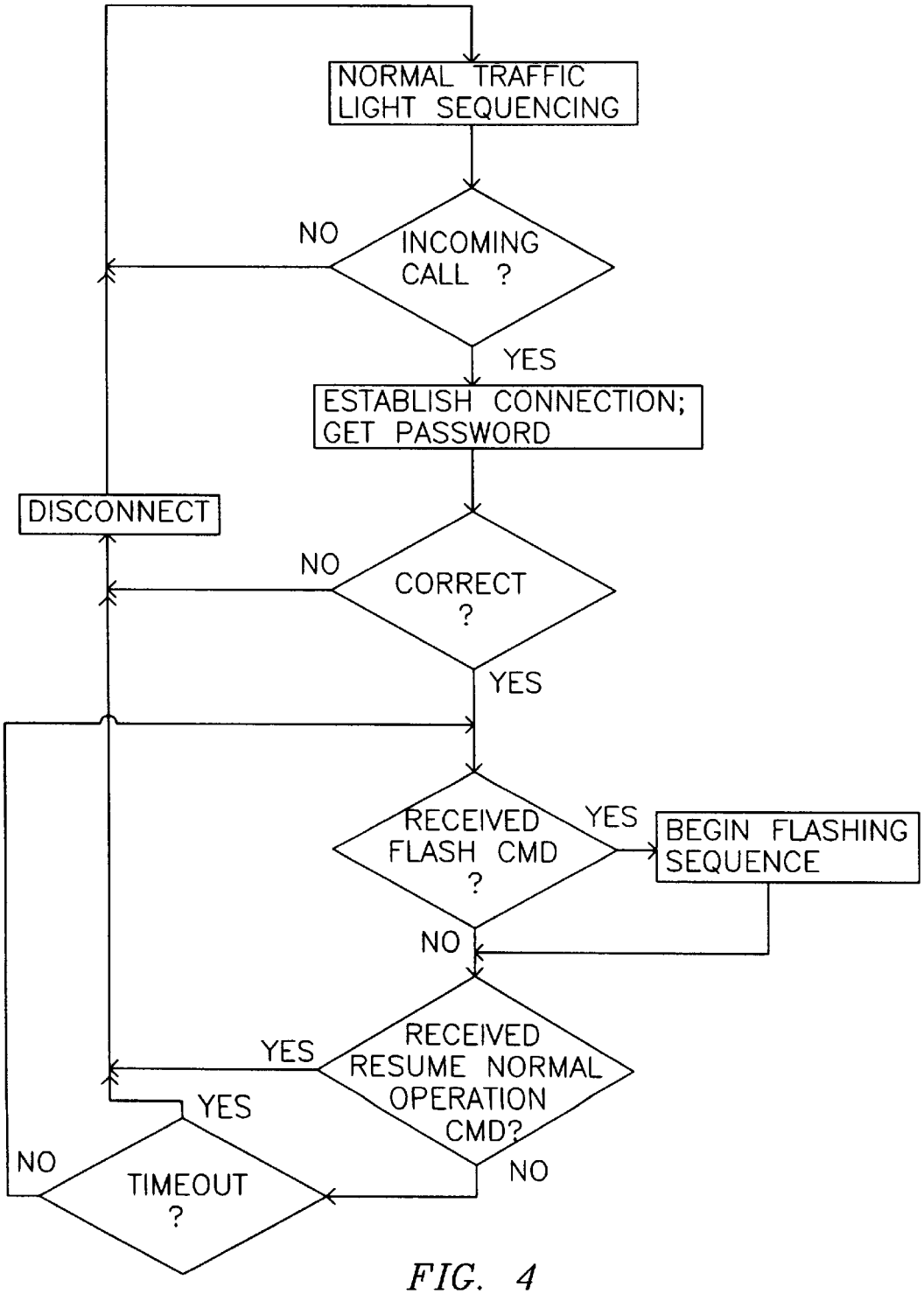
FIG. 4 is a flow chart depicting the operation of the programmable logic controller of the present invention.

The operation of the foregoing components is delineated in the flow chart of FIG. 4. As shown, the components associated with each set of traffic lights are adapted to allow normal operation of the lights until the receipt of an incoming cellular call. At such time, a connection is made by the transceiver and the code, or password, is checked by the programmable logic controller. Only if the code is correct does the programmable logic controller allow the receipt of the activation signal, if it is received at all. Once the activation signal is received, the array of racing lights are continuously flashed. Such flashing is effected in a racing manner (similar to blinking Christmas lights) in all directions to maximize the effectiveness of the present invention in getting motorists attention. This continues until either the receipt of the reset signal or the cessation of a time out.

Next provided is a mobile actuator unit 20 situated in each of a plurality of emergency vehicles. In the alternative, an additional single actuator unit may be located at a centralized location for being used in conjunction with the mobile actuator units. Each actuator unit includes a plurality of selector switches 22 adapted transmit a sequence of binary signals representative of one of a plurality of intersections. Note FIG. 2. As an option, a quick-reference manual may be included which provides the code associated with the traffic signals of the intersections of a local area.

An activation button 24 is included for transmitting the activation signal upon the depression thereof. Associated therewith is a reset button 26 for transmitting the reset signal upon the depression thereof.

Also included as a component of each mobile actuator unit is a ROM look-up table 28. Stored in such memory is a plurality of phone numbers and associated codes each corresponding to one of the aforementioned unique binary sequences.

For reasons that will be disclosed later, a light emitting diode 30 is provided. The light emitting diode is adapted to illuminate upon the actuation thereof.

For communication purposes, a cellular transceiver 32 and modem 34 is provided with each mobile actuator unit. Such transceiver and modem are included for communicating signals over a unique cellular line associated with a unique phone number. Such cellular line is dialed, or connected, upon the receipt of the phone number.

Finally, a microcontroller 40 is connected to the selector switches, activation button, reset button, ROM look up table, light emitting diode, and the cellular transceiver. As an option, the microcontroller may further interface a RS232 mechanism of the emergency vehicle for allowing the operation thereof only upon the actuation of the sirens or lights of the vehicle.

In use, the microcontroller is adapted to transmit the activation signal, a phone number and associated code to the transceiver upon the depression of the activation button. It should be noted that such phone number and associated code correspond to a current binary sequence of the selection switches. As such, the transceiver receives the phone number and transmits the activation signal and code to a cellular transceiver and programmable logic controller of traffic lights associated with the cellular line and code.

The microcontroller is further adapted to transmit the reset signal after the transmission of the activation signal only upon the depression of the reset button. As set forth hereinabove, this allows the traffic lights to resume normal operation. Once the reset button is transmitted, the transceiver is adapted to automatically disconnect the line. To indicate that the programmable logic controller was unable to flash the array of racing lights of a desired set of traffic lights, the microcontroller is adapted to actuate the light emitting diode upon the receipt of the error signal. The microcontroller is further adapted to actuate the light emitting diode when a busy signal is received.

The specific sequence of operation of the microcontroller and associated components is set forth in FIG. 3. As shown, upon the depression of the activation button, a phone number and code corresponding to the current orientation of the selector switch is pulled from memory and used to dial a cellular line via the transceiver. Upon a connection occurring, the code is transmitted along with the activation signal. If for some reason the code is rejected, a received error signal prompts the illumination of the light. At this point, if the code is correct and the activation signal is supplied, the array of racing lights are flashed continuously. The driver then has the option of selectively resuming normal operation of the traffic lights by way of the reset button or, in the alternative, letting the time out function of the programmable logic controller accomplish the same automatically after a predetermined amount of time. It should be noted that the microcontroller is adapted to automatically disconnect from the transceiver of the traffic lights upon either the depression of the reset button or the cessation of a predetermined amount of time, whichever occurs first.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A traffic light remote control system comprising, in combination:

a plurality of traffic lights each situated at a single road intersection and having a green light, a yellow light, and a red light constituting an array of racing lights;

a programmable logic controller connected to each of the traffic lights of the single road intersection and adapted to flash each light of the array of racing lights thereof only upon the receipt of an activation signal with an accompanying unique code associated therewith and further to cease such flashing of the array of racing lights upon at least one of the receipt of a reset signal and the cessation of a predetermined amount of time, the programmable logic controller further adapted to transmit an error signal upon the receipt of the activation signal with an accompanying unique code that is improper;

a cellular transceiver connected to the programmable logic controller with a modem connected therebetween, the modem and cellular transceiver serving to communicate signals over a unique cellular line with a unique phone number dedicated to the plurality of traffic lights of the single intersection; and a mobile actuator unit situated in each of a plurality of emergency vehicles, each actuator unit including:

a plurality of selector switches adapted transmit a sequence of binary signals representative of one of a plurality of intersections, an activation button for transmitting the activation signal upon the depression thereof, a reset button for transmitting the reset signal upon the depression thereof, a ROM look-up table having stored therein a plurality of phone numbers and associated codes each corresponding to a unique binary sequence, a light emitting diode adapted to illuminate upon the actuation thereof, a cellular transceiver for communicating signals over a unique cellular line associated with a unique phone number upon the receipt thereof, and a microcontroller connected to the selector switches, activation button, reset button, ROM look up table, light emitting diode, and the cellular transceiver, the microcontroller adapted to transmit the activation signal, a phone number and associated code to the transceiver upon the depression of the activation button wherein such phone number and associated code correspond to the current binary sequence of the selection switches, the microcontroller further adapted to transmit the reset signal after the transmission of the activation signal only upon the depression of the reset button, wherein the transceiver is adapted to automatically disconnect the line after at least one of the depression of the reset button and the cessation of the predetermined amount of time, whereby after the transmission of the activation signal, the microcontroller is adapted to actuate the light emitting diode upon the receipt of the error signal, the microcontroller further adapted to actuate the light emitting diode upon the receipt of a busy signal;

wherein the microcontroller operates only upon the activation of lights and a siren of the associated vehicle.

* * * * *